US007517248B2

(12) United States Patent
Wan et al.

(10) Patent No.: US 7,517,248 B2
(45) Date of Patent: Apr. 14, 2009

(54) CONNECTOR ASSEMBLY

(75) Inventors: Wei Wan, Hsin-Tien (TW); Shu-Lin Duan, Taipei Hsien (TW)

(73) Assignee: Advanced Connectek Inc. (TW)

( * ) Notice: Subject to any disclaimer, the term of this patent is extended or adjusted under 35 U.S.C. 154(b) by 0 days.

(21) Appl. No.: 11/984,573

(22) Filed: Nov. 20, 2007

(65) Prior Publication Data

US 2008/0124952 A1 May 29, 2008

(30) Foreign Application Priority Data

Nov. 24, 2006 (TW) ..... 95220753 U

(51) Int. Cl.
*H01R 13/648* (2006.01)

(52) U.S. Cl. ..... 439/607; 439/660

(58) Field of Classification Search ..... 439/607, 439/660, 608–610

See application file for complete search history.

(56) References Cited

U.S. PATENT DOCUMENTS 7,165,989 B2 * 1/2007 Huang et al. ..... 439/346
7,217,146 B2 * 5/2007 Meister et al. ..... 439/148
7,252,549 B2 * 8/2007 Nishio et al. ..... 439/607
7,351,105 B2 * 4/2008 Delaney et al. ..... 439/607
2007/0173118 A1 * 7/2007 Chen ..... 439/607
2008/0207052 A1 * 8/2008 Zhang ..... 439/607

* cited by examiner

*Primary Examiner*—Gary F. Paumen
(74) *Attorney, Agent, or Firm*—Hershkovitz & Associates, LLC; Abraham Hershkovitz

(57) ABSTRACT

A connector assembly connects an electronic device to a seat and has a plug connector and socket connector. The plug connector is mounted on the seat and has an insulating plug base, a row of plug terminals and a plug shell formed on the insulating plug base. The insulating plug base has a mounting surface having a rounded edge. The socket connector is connected detachably to the plug connector and has an insulating socket base, a row of plug terminals and a socket shell being formed on the insulating socket base. The insulating socket has a connecting surface having a rounded edge to guide the connecting surface of the insulating plug base into the socket connector. The rounded edges of the insulating plug and socket base facilitate connection of the plug and socket connectors along a curved path to prevent misalignment damage.

9 Claims, 5 Drawing Sheets

CONNECTOR ASSEMBLY

BACKGROUND OF THE INVENTION

1. Field of the Invention

The present invention relates to a connector assembly, and more particularly to a connector assembly that detachably connects an electronic device to a seat mounted on a dashboard of an automobile.

2. Description of Related Art

Global positioning system (GPS) navigators are used for orientation and navigation, especially for vehicular navigation.

GPS navigators may be built-in to a vehicle or portable. Portable GPS navigators are cheaper and more marketable since one unit may be purchased by a user and implemented in a car, boat, bicycle and when the user is on foot as well as being removable for security reasons. However, portable GPS navigators require a connecting means to connect the portable GPS navigator to a dashboard in an automobile to provide similar ease of use as a built-in GPS navigator.

To overcome the shortcomings, the present invention provides a connector assembly to mitigate or obviate the aforementioned problems.

SUMMARY OF THE INVENTION

The main objective of the invention is to provide a connector assembly that detachably connects an electronic device to a seat mounted on a dashboard of an automobile.

The connector assembly in accordance with the present invention connects the electronic device to the seat and comprises a plug connector and socket connector. The plug connector is mounted on the seat and has an insulating plug base, a row of plug terminals and a plug shell mounted on the insulating plug base. The insulating plug base has a mounting surface having a rounded edge. The socket connector is connected detachably to the plug connector and has an insulating socket base, a row of plug terminals and a socket shell formed on the insulating socket base. The insulating socket has a connecting surface having a rounded edge to guide the connecting surface of the insulating plug base into the socket connector. The rounded edges of the insulating plug and socket base facilitate connection of the plug and socket connectors along a curved path to prevent misalignment damage.

Other objectives, advantages and novel features of the invention will become more apparent from the following detailed description when taken in conjunction with the accompanying drawings.

DETAILED DESCRIPTION OF THE PREFERRED EMBODIMENT

Figure 1A:
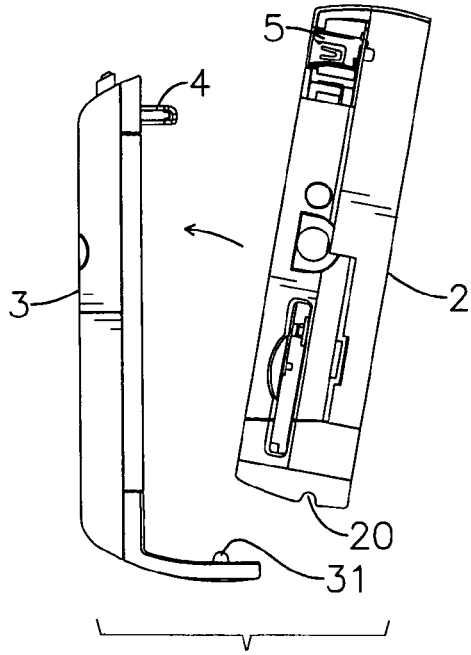
FIG. 1A is an operational side view of an electronic device being mounted to a seat using a connector assembly in accordance with the present invention.
Figure 1B:
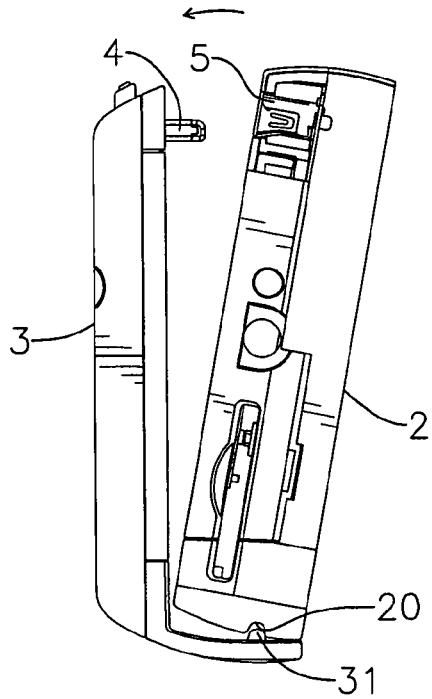
FIG. 1B is an operational side view of the bottom end of the electronic device mounted to the lower support of the seat with the socket connector aligned with the plug connector of the connector assembly in FIG. 1.
Figure 1C:
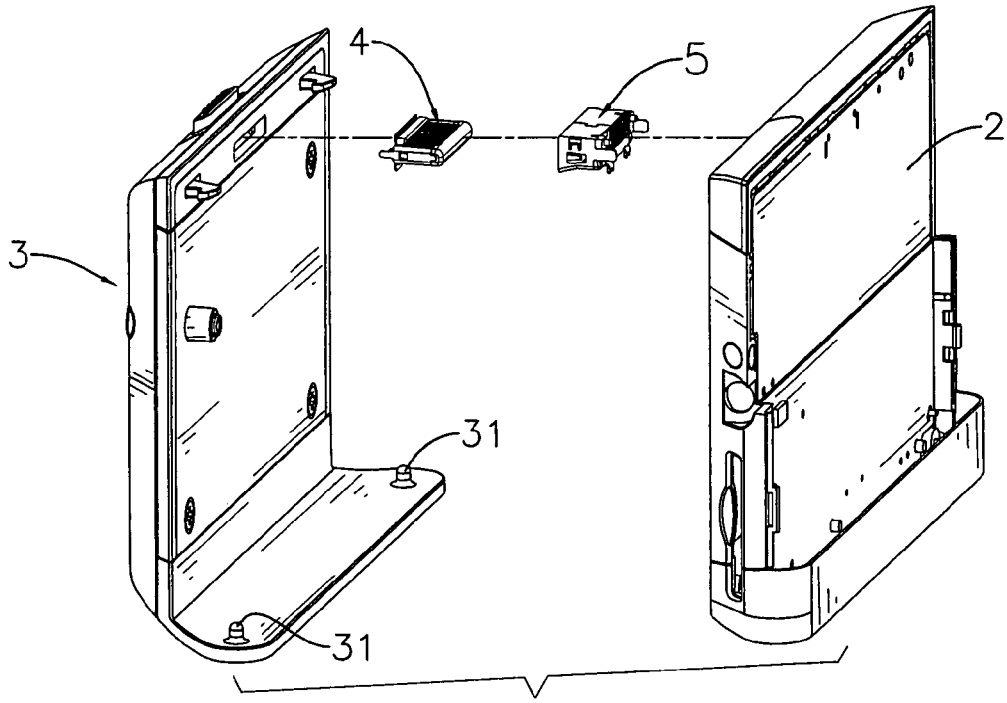
FIG. 1C is an exploded perspective view of the electronic device, the seat and the connector assembly in FIG. 1.

With reference to FIGS. 1A, 1B and 1C, a connector assembly connects an electronic device (2) to a seat (3) on a dashboard of an automobile. The electronic device (2) may be a globally positioning system (GPS) navigator, a MPEG-1 audio layer 3 (MP3) player or a cellular phone and has a bottom end and a pair of positioning notches (20) defined in the bottom end. The seat (3) detachably holds the electronic device (2) and has a lower support and a pair of positioning bosses (31). The lower support is formed on and protrudes perpendicularly from the seat (2). The positioning bosses (31) are formed on the lower support and are engaged respectively with the positioning notch (20) in the electronic device (2).

The connector assembly comprises a plug connector (4) and a socket connector (5).

Figure 2A:
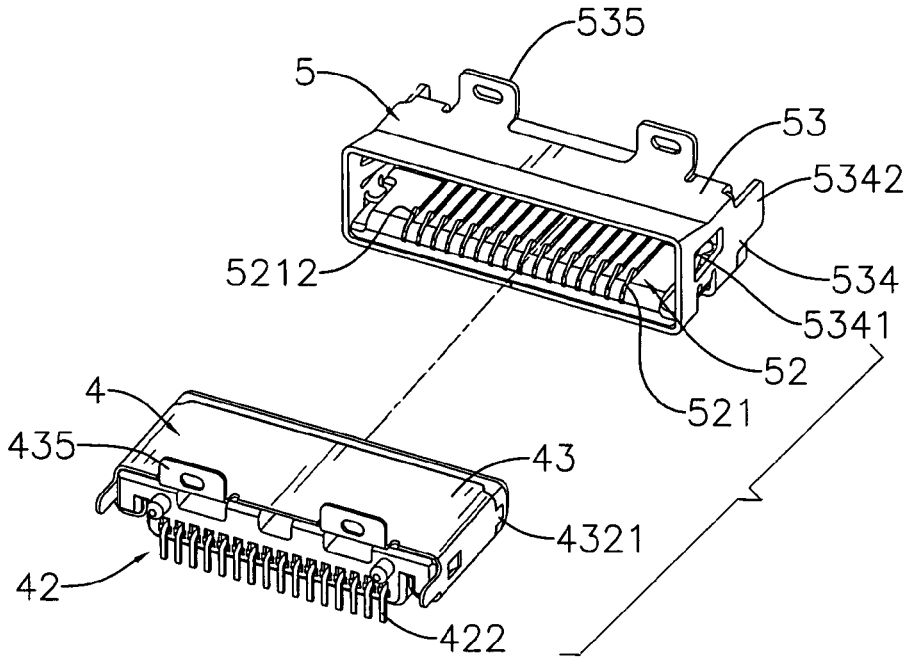
FIG. 2A is a partially exploded perspective view of the connector assembly in FIG. 1, shown disconnected.
Figure 2B:
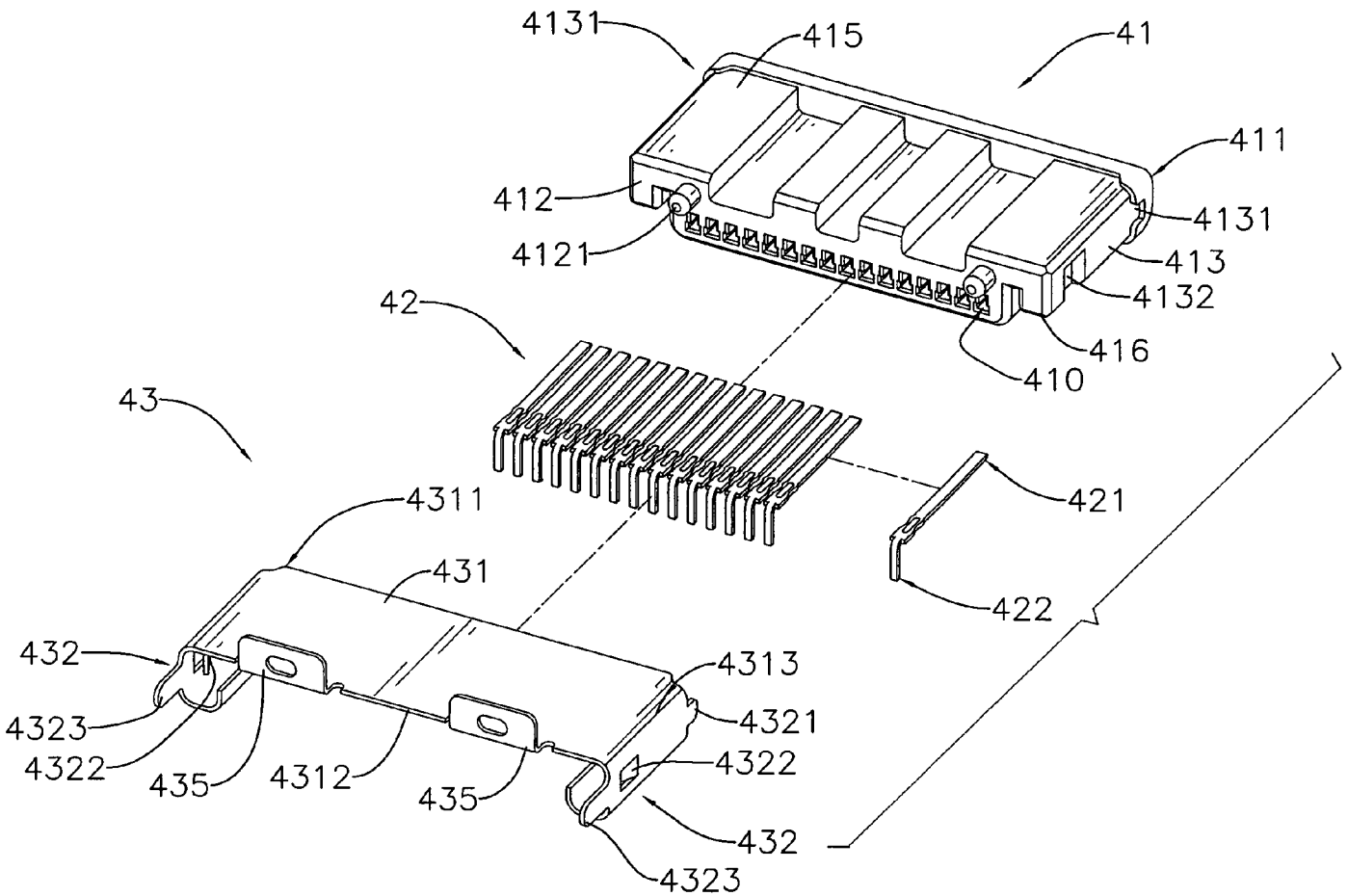
FIG. 2B is an exploded perspective view of a plug connector of the connector assembly in FIG. 2A.

With further reference to FIGS. 2A and 2B, the plug connector (4) is mounted on the seat (3) and has an insulating plug base (41), a row of plug terminals (42) and a plug shell (43).

The insulating plug base (41) has a curved front (411), a rear (412), two opposite sides (413), a top (415), a bottom (416) and a row of terminal passageways (410). The rear (412) is rounded. The rear (412) may have a pair of mounting protrusions (4121) formed on and protruding from the rear (412) and mounted in the seat (3). Each side (413) may have a limiting shoulder (4131) and a positioning recess (4132). The limiting shoulder (4131) is formed on and protrudes from each side (413). The positioning recess (4132) is defined transversely in the side (413). The terminal passageways (410) are defined longitudinally through the insulating plug base (411).

The plug terminals (42) are electrically conductive, correspond to and are mounted respectively in the terminal passageways (410) in the insulating plug base (41) and each plug terminal (42) has a contact portion (421) and a soldering portion (422). The contact portion (421) is mounted in the corresponding terminal passageway (410). The soldering portion (422) is formed on and protrudes perpendicularly from the contact portion (421) and is soldered onto the seat (3).

The plug shell (43) may be metal, is substantially U-shaped, is mounted on the insulating plug base (41) and has a plate (431) and two opposite wings (432) and may further have a plurality of mounting tabs (435). The plate (431) has two opposite side edges and a rear edge. The wings (432) are formed on and perpendicularly protrude respectively from the side edges of the plate (431). Each wing (432) has a front end and a rear end and may further have a limiting tab (4321), a positioning tab (4322) and an insertion tab (4323). The limiting tabs (4321) are formed on and protrude from the front end of each wing (432), abut the limiting shoulders (4131) and prevent the plug shell (43) from sliding off the insulating plug base (41). The positioning tab (4322) is formed on and protrude inward from the wing (432) and engages with one of the positioning recess (4132) to prevent the plug shell (43) from sliding longitudinally or transversely on the insulating plug base (41). The insertion tab (4323) is formed on and protrudes from the rear end of the wing (432) and is mounted in the seat (3). The mounting tabs (435) are formed on and protrude from the rear edge of the plate (431) and each mounting tab (435) has a fastener hole defined through the mounting tab (435). A fastener such as a screw, bolt or rivet is mounted through the fastener hole of the mounting tab to mount the mounting tab (435) on the seat (3).

Figure 2C:
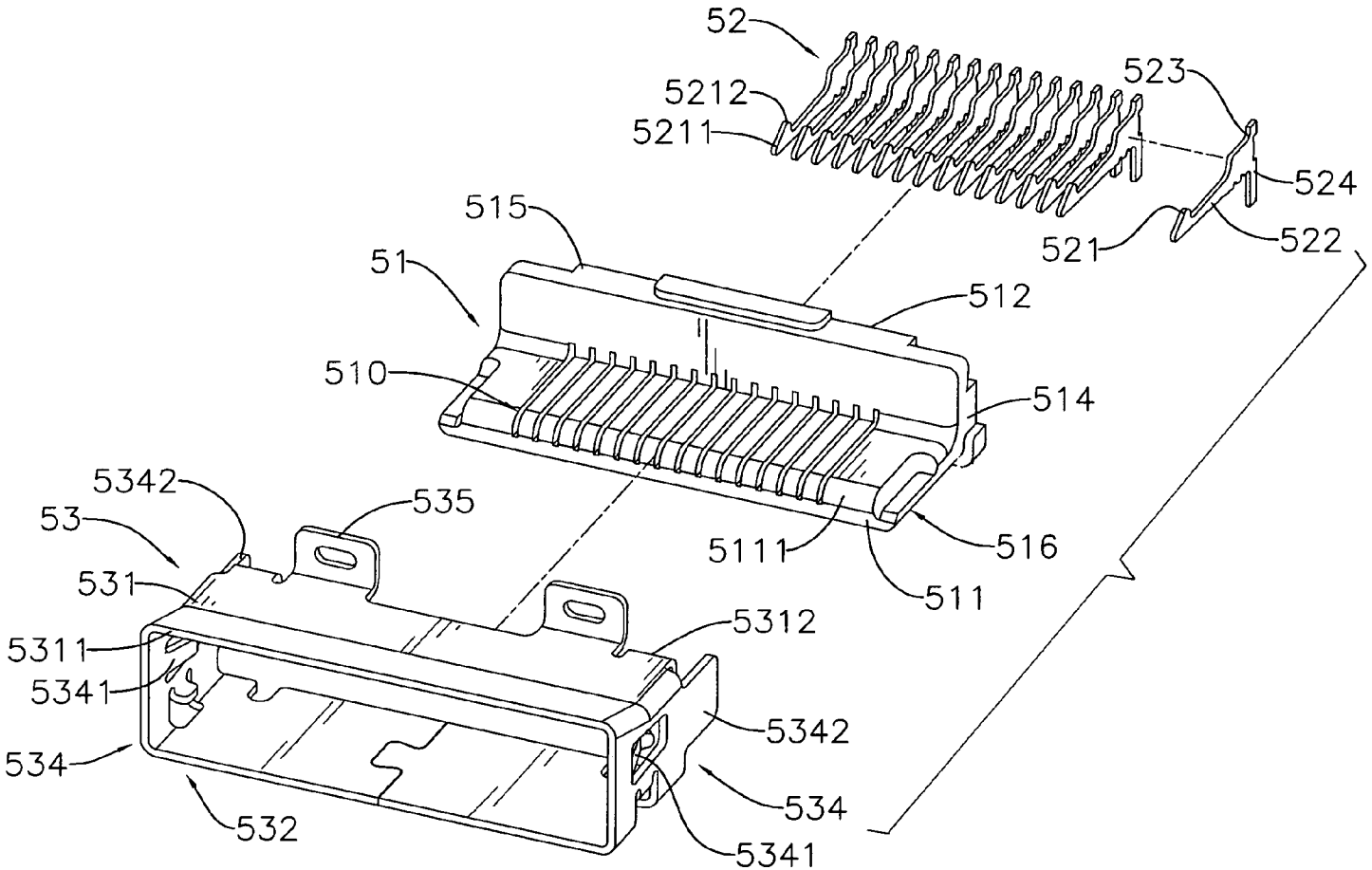
FIG. 2C is an exploded perspective view of a socket connector of the connector assembly in FIG. 2A.
Figure 2D:
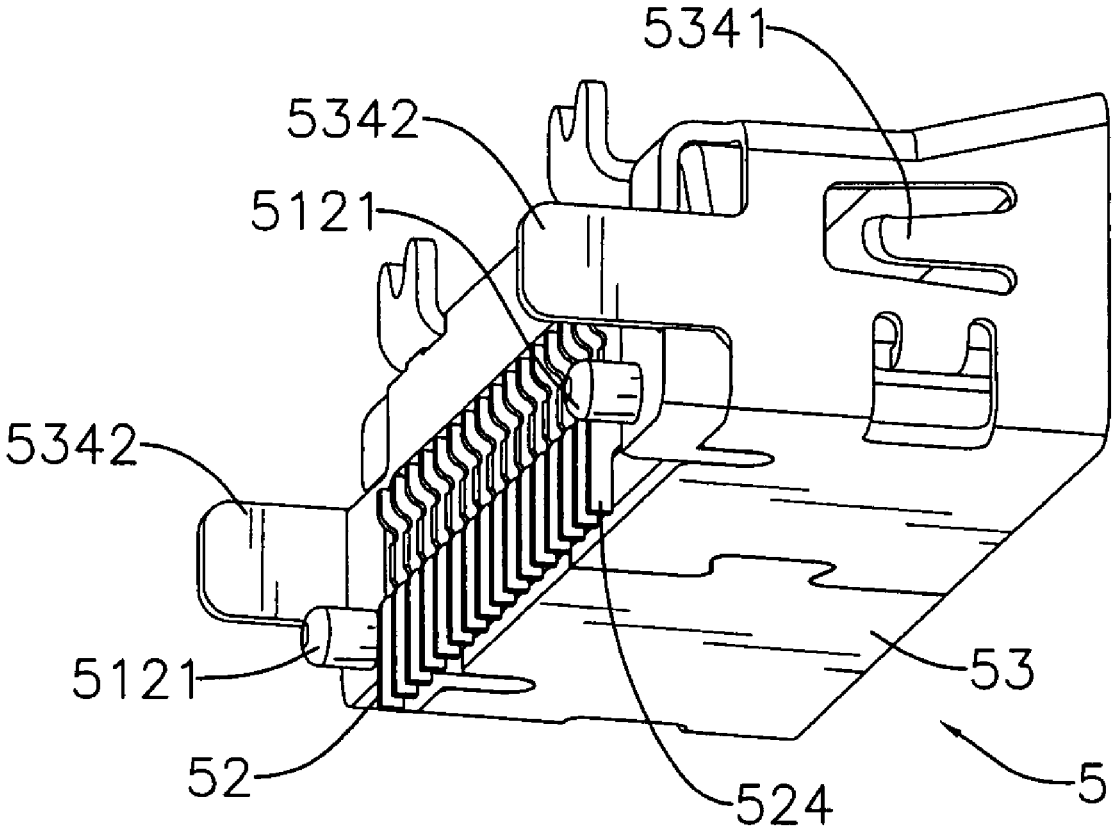
FIG. 2D is an enlarged perspective view of the socket connector in FIG. 2A.

With further reference to FIGS. 2C and 2D, the socket connector (5) is connected detachably to the plug connector (4) and has an insulating socket base (51), a row of socket terminals (52) and a plug shell (53).

The insulating socket base (51) has a curved front (511), a rear (512), two opposite sides (514), a top (515), a bottom (516) and a row of terminal slots (510). The curved front (511) has a rounded edge (5111) to guide and facilitate insertion of the connecting edge (411) of the insulating plug base (41). The rear (512) of the insulating socket base (51) may have a pair of mounting protrusions (5121) formed on and protruding from the rear (512) and mounted in the electronic device (2). The terminal slots (510) are defined longitudinally through the insulating socket base (51).

The socket terminals (52) of the socket connector (5) correspond respectively to the plug terminals (42) of the plug connector (4), correspond to and are mounted respectively through the terminal slots (510) in the insulating socket base (51) and each socket terminal (52) has a body portion (522), a soldering portion (524) and an inclined contact portion (521) and may further have a reinforcing portion (523). The body portion (522) is resilient and is mounted in a corresponding terminal slot (510) in the insulating socket base (51). The soldering portion (524) is formed on and protrudes perpendicularly from the body portion (522) and is soldered onto the electronic device (2). The inclined contact portion (521) is triangular, is formed on and protrudes from the body portion (522) and has an inclined front edge (5211) and a tip (5212). The inclined front edge (5211) is flush substantially with the rounded edge (5111) of the curved front (511) of the insulating socket base (51) and smoothly guides a corresponding plug terminal (42) of the plug connector (4) into the socket connector (5). The tip (5212) protrudes out from the corresponding terminal slot (510) and tightly abuts the contact portion (421) of the corresponding plug terminal (42) of the plug connector (4) to allow stable signal or power transmission. The reinforcing portion (523) is formed on and protrudes from the body portion (522) adjacent to the soldering portion (524) to strengthen the socket terminal (52).

The socket shell (53) is rectangular, may be made of metal, is mounted on and covers the insulating socket base (51) to form a cavity holding the plug connector (4) and has a top (531), a bottom (532) and two opposite sidewalls (534) and may further have a plurality of mounting tabs (535). Each sidewall (534) has a front end and a rear end and may further have a compression tab (5341) and an insertion tab (5342). The compression tab (5341) is formed on the sidewall (534), is inclined inward and presses tightly against one wing (432) of the plug shell (43) of the plug connector (4). The insertion tab (5342) is formed on and protrudes from the rear end of the sidewall (534) and is mounted in the electronic device (2). The mounting tabs (535) are formed on and protrude from the top (531) of the socket shell and each mounting tab (535) has a fastener hole defined through the mounting tab (535). A fastener such as a screw, bolt or rivet is mounted through the fastener hole of the mounting tab to mount the mounting tab (535) on the electronic device (2).

When the electronic device (2) is mounted to the seat (3), the positioning notches (20) in the electronic device (2) engage respectively with the positioning bosses (31). The positioning bosses (31) serve as fulcrums and the electronic device pivots around the fulcrum to align and mount the plug connector (4) into the socket connector (5) along a curved path instead of a linear path. Because the plug connector (4) moves in the curved path, the rounded edge (5111) of the curved front (511) of the insulating socket base (51) smoothly guides the curved front (411) of the insulating plug base (41) of the plug connector (4) easily, reliably and consistently, thereby eliminating damage caused by misalignment.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A connector assembly comprising:

a plug connector having an insulating plug base having a curved front, a rear, two opposite sides, a top, a bottom and a row of terminal passageways defined longitudinally through the insulating plug base;

a row of plug terminals being electrically conductive, corresponding to and mounted respectively in the terminal passageways in the insulating plug base and each plug terminal having a contact portion mounted in a corresponding passageway; and a soldering portion formed on and protruding perpendicularly from the contact portion; and a plug shell being substantially U-shaped, mounted on the insulating plug base and having a plate having two opposite sides and a rear edge; and two opposite wings formed on and perpendicularly protruding respectively from the sides of the plate and each wing having a front end and a rear end; and a socket connector connected detachably to the plug connector and having an insulating socket base having a curved front having a rounded edge guiding and facilitating insertion of the curved front of the insulating plug base;

a rear;

two opposite sides;

a top;

a bottom; and a row of terminal slots defined longitudinally through the insulating socket base;

a row of socket terminals, the socket terminals corresponding respectively to the plug terminals of the plug connector, corresponding to and mounted respectively through the terminal slots in the insulating socket base and each socket terminal having a body portion being resilient and mounted in a corresponding terminal slot;

a soldering portion formed on and protruding perpendicularly from the body portion; and an inclined contact portion being triangular, formed on and protruding from the body portion and having an inclined front edge being flush substantially with the rounded edge of the curved front of the insulating socket base and smoothly guiding a corresponding plug terminal of the plug connector into the socket connector; and a tip protruding out from the corresponding terminal slot and tightly abutting the contact portion of the corresponding plug terminal of the plug connector; and a socket shell mounted on and covering the insulating socket base to form a cavity holding the plug connector and having a top, a bottom and two opposite sidewalls, and each sidewall having a front end and a rear end.

2. The connector assembly as claimed in claim 1, wherein each side of the insulating plug base has a limiting shoulder formed on and protruding from the side; and each wing of the plug shell further has a limiting tab formed on and protruding from the front end of the wing and abutting one of the limiting shoulders of the insulating plug base.

3. The connector assembly as claimed in claim 2, wherein each side of the insulating plug base further has a positioning recess defined transversely in the side; and each wing of the plug shell further has a positioning tab formed on and protruding inward from the wing and engaging with one of the positioning recess of the insulating plug base.

4. The connector assembly as claimed in claim 3, wherein the rear of the insulating plug base further has a pair of mounting protrusions formed on and protruding from the rear; and the rear of the insulating socket base further has a pair of mounting protrusions formed on and protruding from the rear of the insulating socket base.

5. The connector assembly as claimed in claim 4, wherein each wing of the plug shell further has an insertion tab formed on and protruding from the rear end of the wing; and each sidewall of the socket shell has an insertion tab formed on and protruding from the rear end of the sidewall.

6. The connector assembly as claimed in claim 5, wherein the plug shell further has a plurality of mounting tabs formed on and protruding from the rear edge of the plate and each mounting tab has a fastener hole defined through the mounting tab; and the socket shell further has a plurality of mounting tabs formed on and protruding from the top of the socket shell and each mounting tab has a fastener hole defined through the mounting tab.

7. The connector assembly as claimed in claim 6, wherein each sidewall of the socket shell further has a compression tab formed on the sidewall surface, inclined inward and pressing tightly against one wing of the plug shell of the plug connector.

8. The connector assembly as claimed in claim 7, wherein each socket terminal further has a reinforcing portion formed on and protruding from the body portion adjacent to the soldering portion and strengthening the socket terminal.

9. The connector assembly as claimed in claim 7, wherein the plug shell and socket shell are made of metal.

* * * * *